United States Patent [19]

Goncharov et al.

[11] 4,265,738

[45] May 5, 1981

[54] CLEANING AND/OR GRADING MACHINE FOR FREE-FLOWING MATERIALS

[76] Inventors: Evgeny S. Goncharov, ulitsa Lomonosova, 30/1, kv. 46; Anatoly N. Prilutsky, ulitsa Entuziastov, 29/2, kv. 36, both of Kiev; Viktor I. Shevchuk, ulitsa Vokzalnaya, 23, kv. 33, Kievskaya oblast, Vasilkovsky raion, poselok Glevakha, all of U.S.S.R.

[21] Appl. No.: 87,830

[22] Filed: Oct. 25, 1979

[51] Int. Cl.[3] ..... B07B 9/00

[52] U.S. Cl. ..... 209/31; 209/143; 209/148; 209/301; 209/390; 209/407

[58] Field of Search ..... 209/30, 31, 36, 37, 209/301, 303, 304, 389, 390, 148, 150, 384, 145, 149, 407

[56] References Cited

U.S. PATENT DOCUMENTS

| | | | |
|---|---|---|---|
| 459,267 | 9/1891 | Clarkson | 209/145 |
| 2,915,182 | 12/1959 | Burnet et al. | 209/384 X |
| 3,071,248 | 1/1963 | Lowe et al. | 209/406 |
| 4,095,625 | 6/1978 | Marpe | 209/149 X |
| 4,148,719 | 4/1979 | Cerroni | 209/139 R |

FOREIGN PATENT DOCUMENTS

| | | | |
|---|---|---|---|
| 680572 | 8/1939 | Fed. Rep. of Germany | 209/139 A |
| 483153 | 12/1975 | U.S.S.R. | 209/37 |
| 485784 | 1/1976 | U.S.S.R. | 209/301 |
| 487681 | 1/1976 | U.S.S.R. | 209/384 |
| 506439 | 5/1976 | U.S.S.R. | 209/301 |

*Primary Examiner*—Ralph J. Hill

*Attorney, Agent, or Firm*—Burgess, Ryan and Wayne

[57] ABSTRACT

A cleaning and/or grading machine for free-flowing materials comprises at least one cleaning and/or grading unit accommodated in a hollow housing which is secured on a frame and connected with an aspirating chamber; a batching device located in the upper part of said housing; an air separating channel installed in the same housing and comprising a thrower of the free-flowing material; a rotor installed in said housing and comprising a screen drum secured thereon, said drum having a material distributor in the upper part; said screen drum is built up of a number of consecutively arranged sections each consisting of a screen in the form of a body of revolution and secured on supporting rings; the sections are interconnected by equidistant tie rods extending through said supporting rings which makes it possible to assemble these sections into standardized screen drums while the cleaners installed at the external side of said drum opposite to each other relative to the rotation axis of said drum ensure efficient cleaning of the holes of said screen.

10 Claims, 8 Drawing Figures

CLEANING AND/OR GRADING MACHINE FOR FREE-FLOWING MATERIALS

The present invention relates to separating machines and more particularly it relates to cleaning and/or grading machines for free-flowing materials.

The present invention can be used to separate various free-flowing materials in chemical, ore-mining and food industries and very widely to clean and/or grade grain and seeds in agriculture.

BACKGROUND OF THE INVENTION

In many technological processes the cleaning and/or grading machines for free-flowing materials ensure the production of a semi-finished or finished product of the required quality. For example, the modern agriculture methods cannot be practically provided without the use of such machines. Known in the prior art are many types of separating machines which differ from one another mainly by the methods used for separating free-flowing materials into fractions. Of all the types of separating machines used in agriculture the most common ones are the air-and-screen separating machines which separate the free-flowing materials by airblast and screens. In the first place these machines clean the seeds of many types of impurities and grade them in order to select the ones most likely to germinate. Therefore, improvement of the known designs of such machines and creation of radically new ones constitutes a vital technical problem.

Widely known in the prior art are cleaning and/or grading machines for free-flowing materials which comprise a frame on which are mounted one or two vertical air channels with aspirating chambers, a system of flat screens, a drive for vibrating the screens, and screen cleaning devices. In most cases such machines ensure the requisite quality of cleaning and/or grading of free-flowing materials but their output in relation to their size is comparatively low. This should be attributed to the fact that the intensity of separation in these machines is governed mainly by the effect of gravity forces which have a certain value for each kind of mixture of free-flowing materials. Therefore, acceleration of the particles of a free-flowing material during separation does not exceed 9.81 $m/s^2$ which limits the intensity of separation.

Known in the prior art is a cleaning and/or grading machine for free-flowing materials, including grain and seeds (see, for example U.S. Pat. No. 3,794,166. Cl. USA 209/301). This machine comprises a housing with a movably mounted screen made in the form of a body of revolution, a drive which imparts a rotary motion and vertical vibration to the screen, a screen cleaner in the form of a body of revolution installed at one side of the screen and pressed by springs against its external surface. Such a machine gives a considerable gain in the output referred to its mass due to the utilization of the centrifugal forces of inertia of the particles of free-flowing materials for intensifying the process of separation. However, this machine can incorporate only one screen and thus can separate the free-flowing material only into two fractions; the machine has no air separating channel which prevents the free-flowing material from being cleaned and/or graded by the weight of the particles. Inasmuch as the screen cleaner is installed at only one side of the screen, this falls to ensure the required intensity of cleaning of the screen holes because after the screen has turned through an angle equal to approximately $\pi$ radians, these holes are again heavily clogged with the particles of the separated material which cuts down sharply the output and performance of the machine. The use of only one type of hole cleaner with a smooth surface also reduces considerably the efficiency of the machine because a sizable proportion of the particles of the free-flowing material cannot be forced out of the holes by the cleaner of one type alone. These disadvantages reduce substantially the efficiency of such a machine in, say, agriculture.

There are also other known cleaning and/or grading machines for free-flowing materials (see, for example, Author's Certificate USSR No. 506439, Int. Cl. BO7 B 1/44). This machine comprises several identical air-and-screen separating units rigidly secured on the frame, a drive for actuating the working elements of the units, and aspirating chambers connected with said units. Each unit consists of a hollow housing accommodating a consecutively arranged air-separating device and a vertical rotor. Mounted movably on the rotor is a screen drum with several consecutively arranged screens made in the form of a body of revolution. Installed on the upper part of the rotor, coaxially therewith, on bearings is a thrower in the form of a truncated cone with a smooth surface, drive, by the rotor via a reduction unit. The screen drum and screens are of the inseparable construction, the screens being rigidly secured on the drum. At one side of the screen drum are installed screen cleaners made in the form of a body of revolution and provided with a bristly surface. The cleaners are articulated to the unit housing and pressed against the external surface of the screens. For receiving the free-flowing material each unit incorporates a batching device constituted by a cylindrical pipe with a gate installed thereon. The screens are put in vibratory motion by crank-type vibrators rigidly secured to the frame of the machine. The screen drum with screens rotates around a vertical axis and simultaneously vibrates along the same axis.

The free-flowing material delivered into the machine is first treated with air for separating the "light" particles then consecutively by several screens for separating the material into the required number of fractions. Due to the effect of the centrifugal forces of inertia on the particles of the material being separated by the rotating and vibrating screens the output and performance of the latter are radically improved. The amount of the material loaded into the machine can be controlled by changing the height of the gap between the gate and the thrower bottom.

This machine is favourably distinguished from the other prior art machines by high output and versatility, for example, by the possibility of separating the material into more than two fractions and grading it by the weight of particles. However, this machine has substantial disadvantages too. The fact that the screen drum and screens are inseparable and that the screens are rigidly secured on the drum complicates considerably the replacement of screens in case of their wear or when shifting over to treatment of another kind of free-flowing material and reduces substantially the standardization of machines which incorporate screen drums with a different number of screens. The use of only one type of cleaners, e.g. with a bristly surface and installed only at one side of the screen drum constitutes the same disadvantage as that of the other machines. The provision in the machine of the reduction unit for driving the thrower complicates the design and impairs reliability. The batching device in the form of a cylindrical pipe with a gate installed thereon fails to ensure the requisite uniformity of batching of the free-flowing material thus reducing the efficiency of the machine. All these factors taken together complicate the employment of the machine and reduce the degree of standardization of such machines characterized by different output and application.

The main object of the present invention resides in a considerable increase in the efficiency of separation of free-flowing materials.

Another object of the present invention resides in stepping up the degree of standardization of the cleaning and/or grading machines for free-flowing materials of different output and application.

Still another object of the present invention resides in simplifying substantially the replacement of screens in service.

An important object of the present invention resides in simplifying the design of the cleaning and/or grading machine for free-flowing materials.

Another important object of the present invension resides is providing a cleaning and/or grading machine for free-flowing materials wherein a modification of the design of the screen drum, screens, screen hole cleaners, batching device and thrower would increase considerably the efficiency of the machine and simplify its design and operation.

SUMMARY OF THE INVENTION

These and other objects are accomplished by providing a cleaning and/or grading machine for free-flowing materials comprising at least one cleaning and/or grading unit whose hollow housing is secured on the frame and accommodates the consecutively arranged batching device, air-separating channel with a free-flowing material thrower inside, a rotor with a screen, drum whose upper part houses a material distributor, screen cleaners installed at the external side of the drum in direct contact with said external surface, and a drive fastened on the frame and imparting to the drum a rotary and, simultaneously, vibratory motion, each unit being connected with an aspirating chamber wherein, according to the invention, the screen drum is of a built-up construction consisting of several consecutively arranged sections, each section comprising a screen in the form of a body of revolution secured on supporting rings, wherein all the sections are interconnected by the tie rods extending through the supporting rings and wherein the screen cleaners are installed opposite to each other relative to the rotation axis of the drum.

This layout of the machine increases considerably the effectiveness of separation of the free-flowing material and simultaneously improves standardization of such machines of different output and application.

It is practicable that the screen should be of a separable construction, consisting of several sections along its generating surface.

This design of the screen simplifies considerably its replacement in the machine.

The joints between the separable sections of the screen should be enclosed in hollow straps whose walls will serve as stiffener ribs of the screen.

This ensures the requisite sealing of the screen joints and at the same time raises their stiffness in a radial direction.

It is practicable that the screens should be provided with cleaners having smooth and bristly surfaces.

This will ensure a much more efficient cleaning of the screen holes from various particles of the material being separated.

The screen holes cleaner should be made in the form of a body of revolutions, its shaft should be secured on a lever one end of which should be connected by a joint with the unit body, the other end with a damper and the cleaners should be pressed against the external surface of the screen drum by a spring.

This will improve considerably the stability of cleaner pressing against the screen thereby intensifying the cleaning of the hole.

The damper should be made in the form of a friction pair one element of which has the form of a cylinder and is movably linked with the unit body while the other element has the form of a current plate rigidly connected with the other end of the lever; the convex side of the curved plate should be in contact with the cylinder and the centre of curvature of its surface should coincide with the centre of the joint.

This will simplify the design of the damper and extend its service life.

The distributor should be made in the form of a truncated cone whose larger base points upward.

This will ensure a higher uniformity of supply of the material being separated onto the surface of the screen.

The internal surface of the screen drum around the distributor should be provided with longitudinal ribs in the form of plates.

This will prevent tangential slipping of the material over the screen surface and ensure a more uniform distribution of the material over the perimeter of the screen (along the line of its normal section).

The batching device consists of an inlet pipe and an outlet pipe rigidly connected to each other with their longitudinal axis intersecting at an angle approximately equal to $\pi/2$ and the outlet pipe accommodates an adjusting valve.

This ensures uniform batching of the free-flowing material thus improving the quality of separation.

The thrower of the free flowing material is made of a guide cone rigidly connected to a throwing cone, the apices of both cones pointing in opposite directions and the guide cone being arranged coaxially inside the throwing cone whose internal surface matches with the external surface of the guide cone by a toroidal surface; rigidly connected to these surfaces are plate-like vanes whose height is considerably smaller than that of the throwing cone.

This ensures the required speed of delivery of the free-flowing material into the air-separating channel and simplifies the design of the machine due to the reduction unit from the thrower drive.

BRIEF DESCRIPTION OF THE DRAWINGS

Now the invention will be explained by way of examples with reference to the accompanying drawings, in which.

DETAILED DESCRIPTION OF THE INVENTION

Figure 1:
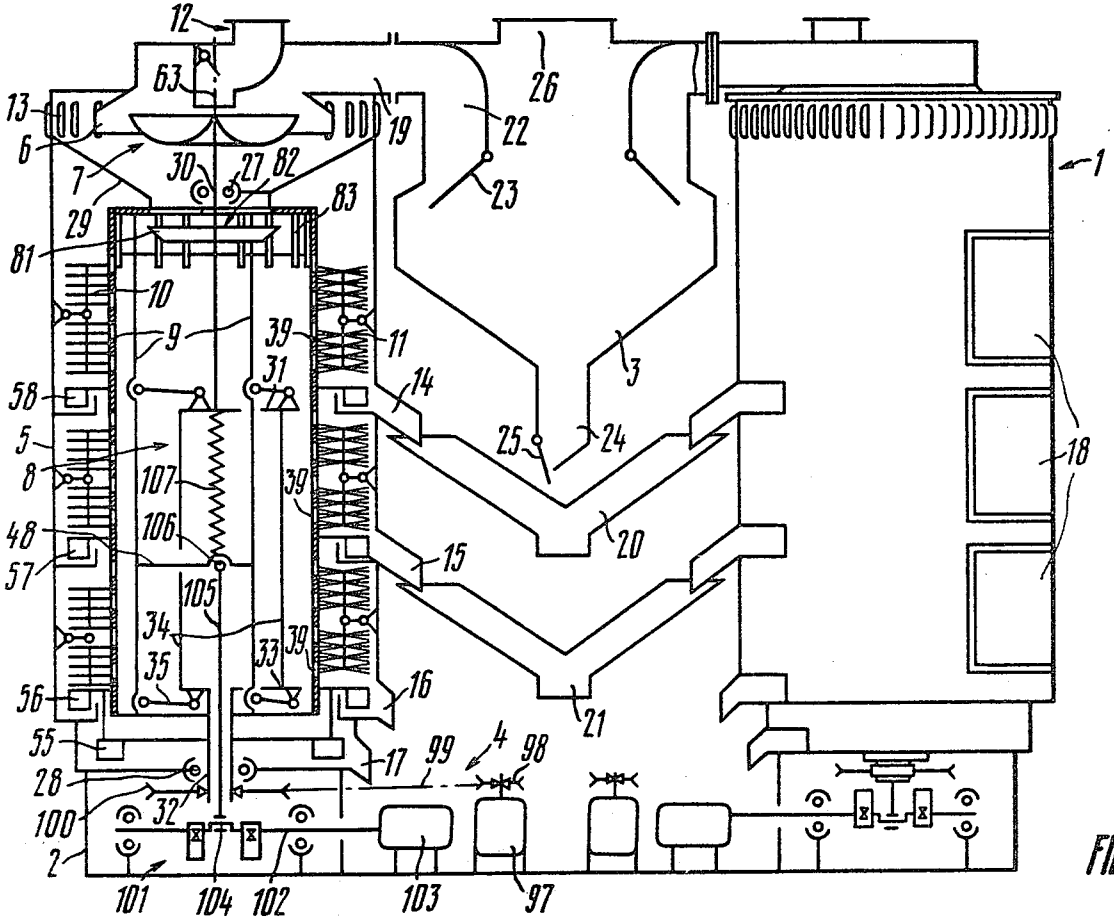
FIG. 1 is a structural diagram of the cleaning and/or grading machine for free-flowing materials according to the invention.

The cleaning and/or grading machine for free-flowing materials comprises, for example, two cleaning and/or grading units 1 (FIG. 1) installed on a common frame 2 and communicated with an aspirating chamber 3. Mounted on the frame 2 are the drives 4 of the units 1. The machine according to the invention may also be provided for example with only one unit 1 which design will be dealt with in detail below.

Each cleaning and/or grading unit 1 comprises a hollow housing 5 mounted on a frame 2. The housing 5 accommodates a circular air-separating channel 6 and a thrower 7 intended to deliver the free-flowing material into the circular channel 6. Located under the separating channel 6 is a rotor 8 (FIGS. 1, 2, 3) with a screen drum 9. Drum cleaners 10 and 11 are installed on the housing 5 (FIGS. 1, 3) at the external surface of the drum 9 in direct contact with the latter.

In the upper part of the housing 5 (FIG. 1) is installed a batching device 12 which delivers the free-flowing material onto the thrower 7.

The walls of the housing 5 are provided with holes 13 admitting air into the channel 6 and with outlet channels 14, 15, 16, 17 and hatches 18. The housing 5 has an outlet 19 into the aspirating chamber 3. The outlet channels 14 and 15 of each unit are interconnected by collectors 20 and 21.

The aspirating chamber 3 has inlet channels 22 with valves 23; it also has an outlet channel 24 with a valve 25, and a channel 26.

The rotor 8 (FIG. 1) is installed on the housing 5 on bearings 27 and 28. The bearing 27 is connected with the housing 5 by a cone 29 which delivers the free-flowing material to the rotor 8.

The rotor 8 (FIGS. 1, 2) has an upper shaft 30 rigidly connected with a plate 31, and a hollow lower shaft 32 rigidly connected with a plate 33. The plates 31 and 33 are rigidly interconnected by three supports 34.

The screen drum 9 is secured on the rotor 8 (FIGS. 1, 2, 3) by means of hangers 35 provided with hinges 36. The hangers 35 are arranged in threes in the upper and lower parts of the screen drum and transmit the rotary movement from the rotor 8 to the screen drum 9, simultaneously permitting the screen drum 9 to reciprocate (vibrate) in a vertical direction.

The screen drum 9 (FIGS. 1, 2, 3) is of a built-up construction consisting for example of two consecutively arranged identical sections 37 and a section 38, each of these sections comprising a screen 39 having the shape of a body of revolution, e.g. cylindrical. It is expedient that the screen 39 (FIG. 2) should be secured on supporting rings 40 and 41 in the section 38 and on supporting rings 41 in the section 37.

Figure 2:
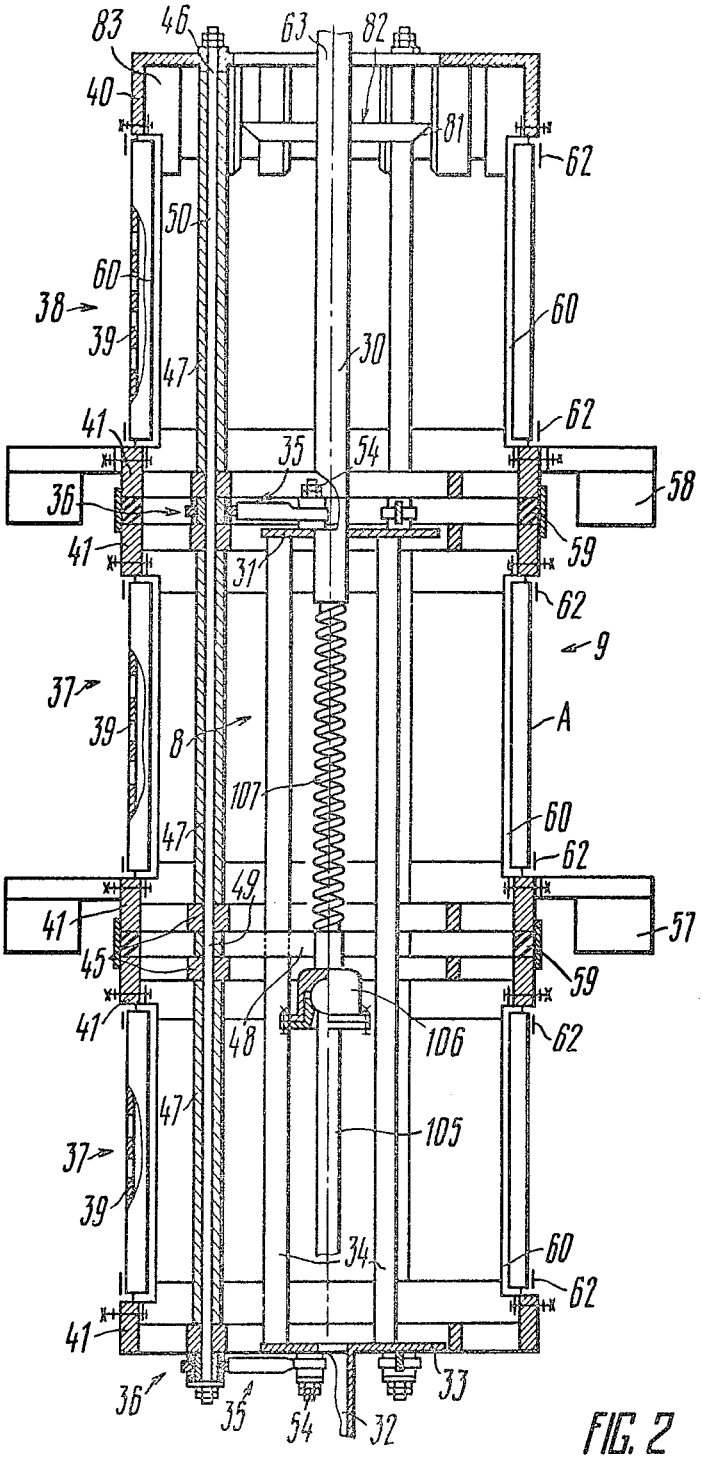
FIG. 2 is a longitudinal section of the rotor of the cleaning and/or grading unit of the cleaning and/or grading machine for free-flowing materials according to the invention.
Figure 3:
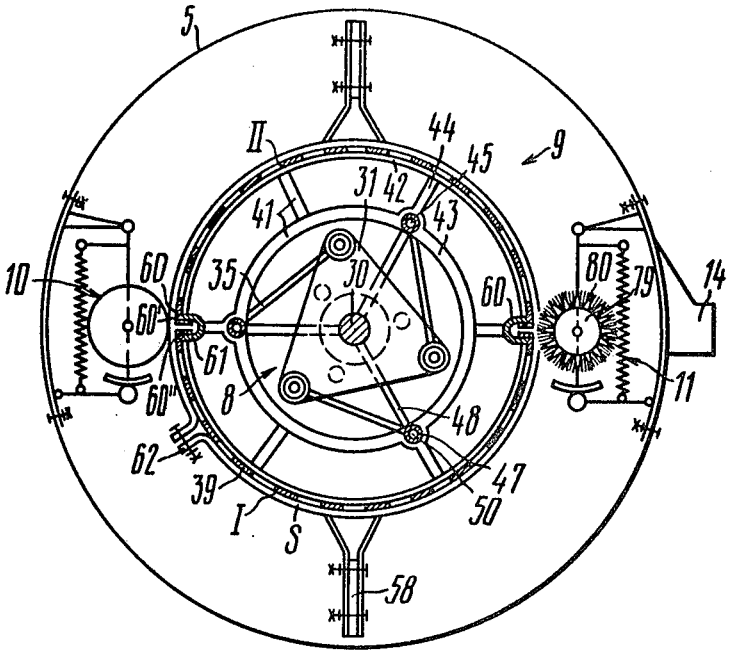
FIG. 3 is a cross section of the cleaning and/or grading unit of the cleaning and/or grading machine for free-flowing materials according to the invention.

The supporting ring 41 (FIG. 3) can be made, for example, of a strong and light material and comprise two concentrically arranged rims 42 and 43 interconnected by ribs 44. The inner rim 43 should have three equidistant through holes 45 (FIGS. 2, 3). The ring 40 (FIG. 2) can be made of the same material and, similarly to the ring 41, have equidistant holes 46.

There should be hollow spacer posts 47 installed between the rings 40 and 41 (FIG. 2) of the section 38 and between the rings 41 of the section 37 opposite the holes 46 and 45 respectively.

Installed between the sections 37 and 38 opposite the holes 45 of the supporting rings 41 are the hinges 36 of the hangers 35 while located between the sections 37 is a crosspiece 48 (FIGS. 1, 2, 3) so that its holes 49 (FIG. 2) coincide with the holes 45 in the supporting rings 41. In the lower part of the screen drum 9 there also are the hinges 36 of the hangers 35 installed opposite the holes 45 of the supporting ring 41. The sections 37 and 38 as well as the hinges 36 and the crosspiece 48 are held together by the equidistant tie rods 50 passing through the holes 46 of the ring 40, the holes 45 of the rings 41, the hinges 36 and the holes 49 of the crosspiece 48.

This design of the screen drum 9 makes it possible to manufacture the screen drums from standardized sections 37 and 38 with a different number of screens in the cleaning and/or grading machines for free-flowing materials of different output and applications. This ensures a high structural standardization of these machines, thus reducing their manufacturing and operating costs.

Figure 4:
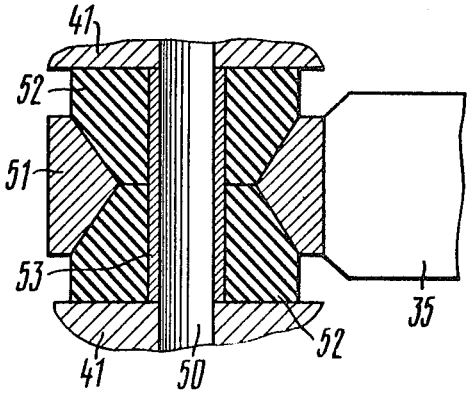
FIG. 4 is a section through the screen drum mounting hinge on the rotor of the cleaning and/or grading unit according to the invention.

The hangers 35 (FIGS. 1, 2, 3, 4) have the form of a rod with rings 51 (FIG. 4) at both ends. These rings receive at both sides sleeves 52 of a flexible and wear-resistant material, e.g. rubber or flexible polyurethane. Installed inside the sleeves 52 are steel sleeves 53 which accommodate a tie rod 50 at one end of the hanger 35 (FIG. 2) and a post 54 at the other end, this post 54 being rigidly connected with the rotor 8. This design of the hangers 36 renders them highly dependable for the required kinematics of the screen drum 9.

Vanes 55 and 56 are rigidly attached to the rotor 8 (FIG. 1) and vanes 57 and 58 (FIGS. 1, 2), to the screen drum 9. These vanes are intended to unload the fractions of the material to be separated from the unit 1 (FIG. 1).

Seals 59 made of a flexible material, e.g. rubber, are installed between the rings 41 (FIG. 2) in the joint between the sections 37 and 38.

The screen 39 (FIGS. 2, 3) is made separable along the generating line "A" (FIG. 2) of its surface, being divided, for example, into two identical parts I and II (FIG. 3). This design of the screen 39 simplifies considerably its replacement in the screen drum (FIGS. 1, 2, 3).

In the disclosed machine the screen 39 may be made separable into a larger number of parts, for example into three or four parts, depending on the screen diameter.

Each section 37 and 38 (FIG. 2) should be provided with hollow straps 60 (FIGS. 2, 3) secured rigidly to the rings 40 and 41. The number of the straps 60 should be equal to the number of the separable parts of the screen 39, e.g. I and II. The jointing portions 61 (FIG. 3) of the parts I and II of the screens 39 should be located between the walls $60^{I}$ and $60^{II}$ of the hollow straps 60. The walls $60^{I}$ and $60^{II}$ serve simultaneously as the radial stiffener ribs of the parts I and II of the screens 39.

This ensures sealing of the parts I and II of the screen 39 at the joints along the generating line "A" (FIG. 2) and extends considerably its service life due to a higher stiffness in a radial direction.

The parts I and II (FIG. 3) of the screen 39 are held more reliably on the supporting rings 40 and 41 (FIG. 2) and in the hollow straps (FIGS. 2, 3) by clamps 62.

Each of the screens 39 (FIGS. 2, 3) is cleaned by the jointly installed two cleaners 10 and 11 (FIGS. 1, 3) arranged opposite each other relative to the rotation axis 63 (FIGS. 1, 2) of the screen drum 9. One of the cleaners, for example 10 (FIGS. 1, 3), has a smooth surface and the other one 11, a bristly surface. The number of the cleaners of types 10 and 11 may be greater, for example four, depending on the diameter of the screen 39. The cleaners 10 and 11 must be made in the form of a body of revolution whose shaft 64 (FIG. 5) is installed in a bearing 65 on a lever 66. One end 66'' of the lever 66 is connected by a joint 67 and support 68 with a plate 69 rigidly secured on the housing 5. The other end 66' of the lever 66 is connected to a damper 70. The damper 70 suppresses the forced vibrations of the cleaners 10 and 11 arising during rotation of the screen drum 9 (FIGS. 1, 2, 3).

The damper 70 (FIG. 5) can be, for example, of a friction type consisting of two elements 71 and 72. It is expedient that the element 71 should be made cylindrical in shape and connected by a post 73 and a hinge 74 with the plate 69. The element 71 is made of, say, textolite, capron, fluorinated plastic, etc.

The element 72 has the form of a curved plate of a hard wear-resistant material and is rigidly connected with the end 66' of the lever 66. The convex side 75 of the element 72 should contact the element 71 and the centre "0" of curvature (radius of curvature "R") of the surface 75 should coincide with the centre "0" of the hinge 67. The surface of the convex side 75 of the element 72 is smooth.

The elements 71 and 72 are pressed against each other by a spring 76 which at the same time presses the cleaners 10 and 11 against the surface of the screens 39 (FIGS. 2, 3, 5) of the screen drum 9 (FIGS. 1, 2, 3) through a post 77 rigidly connected with the lever 66. The friction type of the damper 70 (FIG. 5) ensures simplicity of its design and high operational dependability.

The damper in the disclosed machine may also be hydraulic or magnetoelectric, depending on the abrasive and magnetic properties of the free-flowing material being separated.

The smooth cleaners 10 (FIGS. 1, 3, 5) may be made as, say, discs 78 (FIG. 5) slipped on the shaft 64. It is expedient that these discs should be made from a wear-resistant material.

It is practicable that the bristly cleaners 11 (FIGS. 1, 3) should be in the form of discs 79 (FIG. 3) with resilient bristles 80 secured thereto. The bristles are made of, say, wear-resistant synthetic materials.

The distributor 81 (FIGS. 1, 2) is rigidly connected with the shaft 30 of the rotor 8 and is made in the form of a truncated cone whose large base 82 points upward.

Rigidly secured on the internal surface of the screen drum 9, for example on the ring 40 (FIG. 2) around the distributor 81 are longitudinal ribs 83 (FIGS. 1, 2) in the form of plates. This design of the distributor 81 and the provision of the ribs 83 ensure uniform delivery and distribution of the free-flowing material in the screen drum 9 (FIGS. 1, 2, 3).

Figure 6:
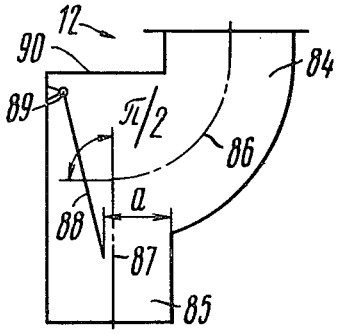
FIG. 6 is a section through the batching device of the cleaning and/or grading unit according to the invention.

The batching device 12 (FIGS. 1, 6) consists of an inlet pipe 84 (FIG. 6) and an outlet pipe 85. The longitudinal axes 86 and 87 of the inlet pipe 84 and outlet pipe 85 intersect at an angle which is approximately equal to $\pi/2$. Installed inside the outlet pipe 85 is an adjusting valve 88 secured by a hinge 89 to the pipe 85 which permits changing the size of the gap "a". On top, the outlet pipe 85 is closed with a cover 90 which can be made removable.

Figure 7:
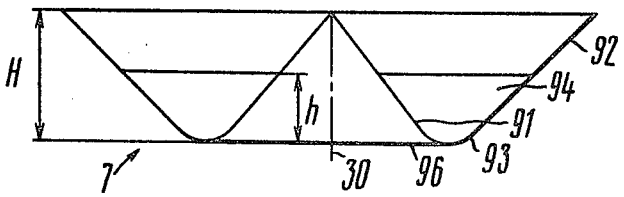
FIG. 7 is a section through the material thrower according to the invention.
Figure 8:
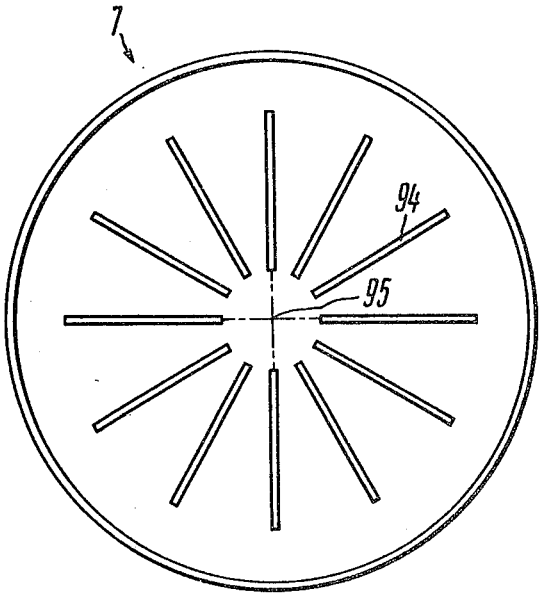
FIG. 8 is a top view of the material thrower according to the invention.

The thrower 7 (FIGS. 1, 7, 8) comprises a guide cone 91 rigidly connected to a thrower cone 92 (FIG. 7). The cone 91 is arranged coaxially inside the cone 92 and the cone apices point in opposite directions. The internal surface of the thrower cone 92 matches with the external surface of the guide cone 91 by a toroidal surface 93. Rigidly secured to these surfaces are plate-like vanes 94 (FIGS. 7, 8) which can be arranged, for example, radially with relation to the centre 95 (FIG. 8) of the base 96 (FIG. 7) of the thrower 7 (FIGS. 1, 7, 8). The height h of the plate-like vanes 94 is considerably smaller than the height H of the thrower cone 92. The base 96 of the thrower 7 is rigidly connected with the upper shaft 30 (FIGS. 1, 2, 3, 7) of the rotor 8 (FIGS. 1, 2).

Rotary motion is imparted to the rotor 8 of each unit 1 (FIG. 1) by an electric motor 97 with a pulley 98 installed on the frame; the pulley is connected by a belt transmission 99 with a pulley 100 rigidly secured on the rotor 8.

Vibratory motion along the axis 63 is imparted to the screen drum 9 (FIG. 1) by a vibrator 101 installed on the frame 2 and provided with a crank shaft 102 connected with an electric motor 103. The crank 104 of the shaft 102 is linked movably with a rod 105 (FIGS. 1, 2) which is connected with the crosspiece 48 by a spherical bearing 106.

To relieve the crank shaft 102 (FIG. 1) of the weight of the screen drum 9, the crosspiece 48 is connected by a spring 107 with the shaft 30 (FIGS. 1, 2) of the rotor 8. In this way the weight of the screen drum 9 is applied to the rotor 8.

Should it become necessary to reduce the rated output of the machine according to the invention, it may be used with, say, only one unit 1 (FIG. 1). In this case the number of drives 4 will be correspondingly reduced, the dimensions of the frame will diminish proportionally and the aspirating chamber 3 will be made with a correspondingly smaller number of channels 22 and valves 23. The collectors 20 and 21 are eliminated altogether.

The cleaning and/or grading machine for free-flowing materials realized according to the present invention functions as follows. As the electric motor 97 (FIG. 1) is switched on, the rotor 8 is set in rotation via the belt transmission 99. Simultaneously, the rotary motion is transmitted via the hangers 35 (FIGS. 1, 2, 3) from the rotor 8 to the screen drum 9. The cleaners 10 and 11 (FIGS. 1, 3) pressed against the screens 39 (FIGS. 2, 3) of the screen drum 9 (FIGS. 1, 2) also start rotating due to the effect of the forces of friction.

As the electric motor 103 (FIG. 1) is turned on, the crank shaft 102 of the vibrator 101 also starts rotating so that the rod 105 imparts via crosspiece 48 vibratory (reciprocating) motion of the screen drum 9 (FIGS. 1, 2) along the axis 63.

The free-flowing material to be separated enters at a certain velocity into the inlet pipe 84 (FIG. 6) of the batching device 12 (FIGS. 1; 6) of each unit 1 (FIG. 1), Inasmuch as the batching device is realized in accordance with the present invention, the stream of the free-flowing material is directed by the inlet pipe 84 into the outlet pipe 85 at an almost straight angle to the surface of the adjusting valve 88 and this reduces sharply the velocity of the stream of the material being separated. From the outlet pipe 85 the material emerges at an almost constant speed which depends but very little on the velocity with which the material has entered the pipe 84. The amount of the material is batched by changing the size of the gap "a" which is achieved by turning valve 88 in the hinge 89. This ensures uniform batching of the free-flowing material when the disclosed machine is used under various conditions which improves considerably the efficiency of the machine.

From the outlet pipe 85 (FIG. 6) the material being separated falls in a metered stream on the guide cone 91 (FIG. 7) of the thrower 7 (FIGS. 1, 7, 8). This cone delivers the material uniformly to the vanes 94 (FIGS. 7, 8) while the toroidal surface 93 (FIG. 7) feeds it freely into the inner surface of the thrower cone 92. The vanes 94 accelerate sharply the movement of the material and deliver it in uniform streams to the upper part (H-h) of the thrower cone 92. On this portion of the smooth surface of the cone 92 individual streams of the material merge into a solid flow which is then introduced at the required speed into the circular air separating channel 6 (FIG. 1). This design of the thrower 7 (FIGS. 1, 7, 8) attains two effects simultaneously, i.e. imparts the required velocity to the material being separated and distributes it uniformly in the separating channel 6.

A fan installed, for example, outside of the disclosed machine, builds up a stream of air flowing through the holes 13 (FIG. 1), circular channel 6, outlet 19, channel 22, aspirating chamber 3, channel 26, and thence, through an additional air duct, to the fan. The material distributed by the thrower 7 in the circular channel 6 is blown by the air stream which separates "light" particles from said material and carries them into the aspirating chamber 3 from where they are unloaded into the channel 24 and are conducted through the valve 25 into the collector 20.

The velocity of the air flow in the circular channel 6 is controlled by the valve 23.

The material treated with air is directed by the cone 29 onto the distributor 81 rotating jointly with the rotor 8. Due to the design of the distributor 81 according to the present invention the free-flowing material slides over its internal surface radially and tangentially and is thus uniformly distributed over the internal surface of the ring 40 (FIG. 2) which is provided with ribs 83 (FIGS. 1, 2). The ribs 83 catch equal portions of the free-flowing material and rotate them at a speed equal to the rotation speed of the screen drum 9. At the same time the ribs 83 prevent said portions of the material from sliding tangentially over the internal surface of the ring 40 (FIG. 2). All these factors ensure uniform distribution of the material along the perimeter S (FIG. 3) of the screens 39 (FIGS. 2, 3) which is vital for highly efficient peformance of the screens 39. This increases the output and the performance of the screens 39.

Joint rotation of the material with the screen drum 9 (FIG. 2) creates a centrifugal force of inertia which presses the material against the internal surface of each screen 39 while the vibratory motion of these screens jointly with the screen drum 9 creates an additional force of inertia which interacts with the weight of the particles and ensures the progressive downward motion of the material over the surface of the screens 39. Taken together, all these factors ensure intensive shifting, for example, of the smallest particles by the upper screen 39 (FIG. 2), of larger particles by the middle screen 39 and of still larger particles, by the lower screen 39. Each fraction of the free-flowing material is unloaded, respectively, by the rotating vanes 58, 57, 56 (FIGS. 1, 2) into the outlet channels 14, 15, 16 (FIG. 1).

The largest particles of the material being separated from the lower screen 39 and are unloaded by the vanes 55 into the outlet channel 17. In this manner the source mixture of the free-flowing material is divided into the required number of fractions which is an important advantage of the disclosed machine as compared with the prior art machines.

The hollow straps 60 (FIGS. 2, 3) prevent the material from falling through at the joining zones 61 (FIG. 3) of the parts I and II of the screens 39 which rules out the possibility of contamination of the produced fractions of the free-flowing material thereby improving the operational standard of the machine according to the invention.

As the free-flowing material is being sifted through the screens 39 (FIGS. 2, 3), their holes are intensively clogged with the particles of the material. The cleaners 10 and 11 (FIGS. 1, 3) force these particles out of the holes. The fact that the cleaners 10 and 11 are set opposite to each other relative to the rotation axis 63 (FIGS. 1, 2) of the screen drum 9 (FIGS. 1, 2, 3) according to the invention, ensures a more intensive cleaning of the holes in the screens 39 (FIGS. 2, 3) than can be obtained in the previously known machines wherein the cleaners of the type 10 or 11 are installed at one side of the screen drum. This likewise conduces to a substantial improvement of performance of the screens 39.

The use of the cleaners with a smooth surface 10 (FIGS. 1, 3) jointly with the cleaners with a bristly surface 11 in the machine according to the present invention also improves the cleaning of the holes in the screens 39 (FIGS. 1, 2, 3) because the smooth cleaners 10 characterized by sufficient stiffness are more efficient in freeing the screen holes from the firmly stuck particles which mainly stand out above the external surface of the screens 39. The cleaners 11 (FIGS. 1, 3) with flexible bristles 80 (FIG. 80) are more efficient in forcing out the particles that are embedded deep in the screen holes. Just the joint utilization of the cleaners 10 and 11 ensures a by far more effective cleaning of the holes than their separate employment; this additionally raises the output and performance of the machine according to the present invention.

Figure 5:
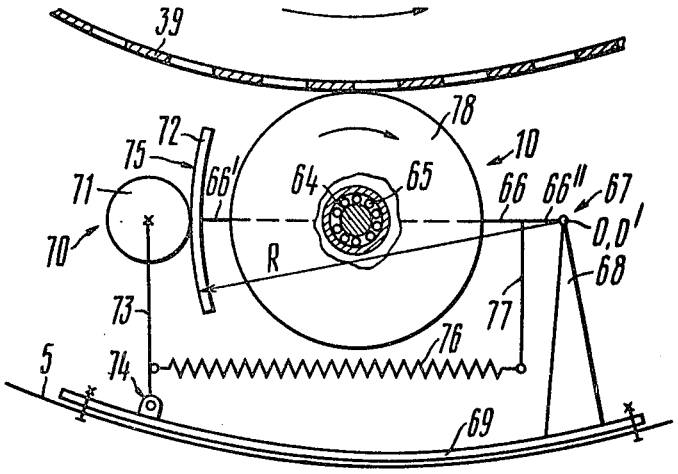
FIG. 5 is a structural diagram of the screen cleaner and its fastening to the body of the cleaning and/or grading unit according to the invention.

As the cleaners 10 and 11 (FIG. 3) roll over the surface of the screens 39, they break contact with these screens periodically due to a number of factors acting on the cleaners 10, 11 such as, for example, the action of the particles standing out of the holes. This motion of the cleaners 10 and 11 reduces the intensity of hole cleaning. The negative effect of this phenomenon is considerably limited by connecting the cleaners 10 and 11 with a friction damper 70 (FIG. 5). When the cleaner 10 or 11 (FIGS. 3, 5) breaks off from the screen 39, the element 72 (FIG. 5) of the damper 70 is displaced relative to the element 71 so that a considerable proportion of the kinetic energy of the cleaner 10 or 11 is spent for doing work by the forces of friction originated by the contact between the elements 71 and 72. The curved-plate shape of the element 72 whose centre of curvature "0'" coincides with the centre "0" of the hinge 67 and the cylindrical shape of the element 71 ensure smooth movement (sliding) of the element 71 without scoring and wedging over the convex surface 75 of the element 72. This increases considerably the reliability of the damper 70 and the standard of cleaning of the screens 39 by the cleaners 10 and 11 (FIGS. 1, 3).

In this type of cleaning and/or grading machines for free-flowing materials it is essential that the screens should be efficiently cleaned easily removable and standardized. It is just due to the fact that the screen drum 9 (FIGS. 1, 2) is built up of several sections 37 and 38, that the screens 39 are of the separable construction consisting for example of two parts I and II along the generating surface and that the screen cleaners 10 and 11 are installed opposite each other according to the invention, the machine acquires the basic advantage, that of a considerably higher efficiency and a high degree of standardization. Besides, the joint employment of the smooth and bristly cleaners 10 and 11 and their joining with the friction damper 70 realized according to the invention improves still more the efficiency of the machine due to a more intensive cleaning of the screen holes. In addition to this effect, the uniform delivery of the material onto the screens 39 due to the provision of the distributor 81 and ribs 83 according to the invention improves considerably the efficiency of the disclosed machine.

Besides, the efficiency of the disclosed machine is increased due to the design of the batching device 12 (FIGS. 1,6) according to the invention which ensures uniform batching of the free-flowing materials thereby improving their separation. The quality of separation of the free-flowing materials is also improved because the thrower 7 (FIGS. 1, 7, 8) realized according to the invention imparts an optimum velocity to the material and distributes it uniformly in the separating channel 6 (FIG. 1).

We claim:

1. A separating machine for free-flowing materials comprising at least one separating unit; a frame on which said unit is mounted; an aspirating chamber connected with the outlet of said unit; said unit comprising a hollow housing; a feeding means located in the upper part of said housing; a first distributor for the free-flowing material located below said feeding means inside of said hollow housing; an air separating zone formed by said hollow housing and said first distributor; a rotor installed in said housing; a screening drum mounted on said rotor with provision for movement relative thereto; a second distributor of the free-flowing material in the upper part of said screening drum mounted on said rotor; said screening drum comprising a plurality of sections, each section comprising a screen in the form of a body of revolution; supporting rings on which said screen is mounted; tie rods extending through said supporting rings of all said sections to connect them to one another; hole cleaners for said screen installed at the external side of said drum; a drive means mounted on said frame connected to said screening drum for simultaneously rotating and vibrating said screening drum.

2. A separating machine for free-flowing materials of claim 1 wherein said screen is replaceable and comprises a plurality of pieces of screen arranged along its generating surface.

3. A separating machine for free-flowing materials of claim 2 wherein the joints between said pieces of screen are enclosed in hollow straps whose walls serve as stiffener ribs of said screen, said hollow straps arranged inside of said screening drum.

4. A separating machine for free-flowing materials according to claim 1 wherein said hole cleaners comprise at least one set of cleaners with a smooth surface and at least one set of cleaners with a bristle surface and wherein the cleaners with the smooth surface are stiffer than the cleaners with the bristle surface.

5. A separating machine for free-flowing materials of claim 4 wherein each of said cleaners comprises a body of revolution pressed against the external surface of said screen by a spring; a shaft carrying said body of revolution; a lever on which said shaft is movably secured, a first end of said lever being linked by a hinge with said hollow housing, and a damper means connected to the second end of said lever.

6. A separating machine for free-flowing materials of claim 5 wherein said damper means comprises a friction pair comprising two elements; the first element is in the shape of a cylinder and is linked movably by means of an upright with said hollow housing; the second element has the shape of a curved plate which is rigidly connected with the second end of said lever; the convex side of said curved plate is in contact with said cylinder and the center of curvature of the surface of said curved plate coincides with the center of said hinge which links said first end of said lever with said hollow housing, and wherein the hardness of the surface of said second element is greater than the hardness of the surface of said first element.

7. A separating machine for free-flowing materials according to claim 1 wherein the internal surface of said screening drum around said distributor is provided with longitudinal ribs.

8. A separating machine for free-flowing materials according to claim 7 wherein said distributor is made in the form of a truncated cone whose larger base points upward.

9. A separating machine for free-flowing materials according to claim 1 wherein said feeding means comprises an inlet pipe and an outlet pipe rigidly interconnected with each other so that the longitudinal axes of said pipes intersect at an angle approximately equal to $\pi/2$, and an adjusting valve installed inside of said outlet pipe.

10. A separating machine for free-flowing materials according to claim 1 wherein said first distributor for the free-flowing material comprises a guide cone and a distributor cone, said guide cone being arranged coaxially inside of said distributor cone, the apices of said cones point in opposite directions and the internal surface of said distributor cone is matched with the external surface of said guide cone by a toroidal surface, said surfaces being provided with rigidly connected plate-like vanes wherein the height of said vanes is considerably shorter than the height of said distributor cone.

* * * * *